US005090381A

United States Patent [19]

Tanabe

[11] Patent Number: 5,090,381

[45] Date of Patent: Feb. 25, 1992

[54] METHOD OF AND APPARATUS FOR CONTROLLING AN IDLING CONTROL VALVE OF AN INTERNAL COMBUSTION ENGINE

[75] Inventor: Yoshiyuki Tanabe, Katsuta, Japan

[73] Assignee: Hitachi, Ltd., Tokyo, Japan

[21] Appl. No.: 608,349

[22] Filed: Nov. 2, 1990

[30] Foreign Application Priority Data

Nov. 17, 1989 [JP] Japan ..... 1-300157

[51] Int. Cl.[5] ..... F02D 41/00

[52] U.S. Cl. ..... 123/339; 123/585

[58] Field of Search ..... 123/339, 585

[56] References Cited

U.S. PATENT DOCUMENTS 4,303,048 12/1981 Nishio ..... 123/585
4,356,802 11/1982 Kern et al. ..... 123/339

FOREIGN PATENT DOCUMENTS 0155239 9/1983 Japan .
0136541 8/1984 Japan ..... 123/339
61-15257 4/1986 Japan .
0092565 4/1989 Japan ..... 123/339

*Primary Examiner*—E. Rollins Cross
*Assistant Examiner*—Robert E. Mates
*Attorney, Agent, or Firm*—Antonelli, Terry, Stout & Kraus

[57] ABSTRACT

A control of an idling control valve which is arranged in a bypass air passage bypassing a throttle portion of a suction passage of an internal combustion engine and controlled by electric signals is carried out by setting an upper limit of electric current flowing in a drive circuit for the idling control valve, suppressing the electric current flowing into the drive circuit not to exceed the upper limit when an usual idling is effected, and releasing the electric current from the upper limit to flow electric current of a value larger than the upper limit to the drive circuit for a short time at a certain time of engine operation and/or at regular intervals.

12 Claims, 4 Drawing Sheets

METHOD OF AND APPARATUS FOR CONTROLLING AN IDLING CONTROL VALVE OF AN INTERNAL COMBUSTION ENGINE

BACKGROUND OF THE INVENTION

This invention relates to a method of and an apparatus for controlling an idling control valve of an internal combustion engine, which method or apparatus can provide stable control of the idling control valve with relatively little electric current.

In an internal combustion engine for automobiles, etc., a target idle r.p.m. is determined with respect to an engine condition, such as engine temperature, in view of the level of purification of the exhaust gas, improvement in fuel consumption, etc., and such a technique is put into practice in such a way that real engine r.p.m. is caused to reach a target r.p.m. at a time of idling through feedback control. An example of the above-mentioned idle r.p.m. control is disclosed in Japanese Patent Publication No. 61-15257 (1986), wherein an idle control valve is disposed in a bypass passage bypassing a throttle portion of a suction passage, and current for driving the valve is changed with respect to engine temperature, such as engine cooling water temperature, thereby controlling the opening of the idle control valve followed by an idle air flow rate control. Some of these systems operate with the idle control valve kept opened to a predetermined opening at a time when the vehicle is under a condition of steady running. Another system is disclosed in Japanese Laid-Open No. 58-155239, wherein the opening of the idle control valve is increased temporarily when the engine is shifted from a steady running condition to a deceleration running condition whereby the vehicle can run smoothly during deceleration.

For the above-mentioned idle control systems, it is desirable to reduce an upper limit value of electric current for driving the valve to a value as little as possible in order to reduce electric power consumption and heat generation in the drive circuit in case the usual idle control valve control is effected.

For the idle control system in which the upper limit of the electric current is set to a small value, a movable part, such as the valve body, may stick to a supporting portion of the valve body when some substances, such as dust, adhere to the surfaces and the adhesion is heavy. In such a case, the valve body may not move even if electric current is supplied to the drive circuit because the electric current is restricted to the upper limit of the small value and is insufficient to move the valve body against the sticking force. Thus, in case the upper limit of the electric current to the drive circuit of the idle control value is set to a small value and some substances adhere to the surfaces, a stable operation of the idle control valve can not be expected.

SUMMARY OF THE INVENTION

An object of the invention is to provide a method of and apparatus for controlling an idling control valve which can suppress sufficiently heat generation in the valve with less power consumption at idling time, and effect surely a smooth idling control with a simple construction without fault in an operation thereof even when substances such as dust adhere to the valve.

According to the present invention, a control of an idling control valve which is arranged in a bypass air passage bypassing a throttle portion of a suction passage of an internal combustion engine and controlled by electric signals is carried out by setting an upper limit of electric current flowing in a drive circuit for the idling control valve, suppressing the electric current flowing into the drive circuit so as not to exceed the upper limit when an usual idling is effected, and releasing the electric current from the upper limit to permit a flow of electric current at a value larger than the upper limit to the drive circuit for a short time at a certain time of engine operation and/or at regular intervals.

The above-mentioned value of electric current larger than the upper limit is to be sufficient to generate a force for driving the idling control valve against a sticking force or adhesion force caused by adhesion of dust, greasy substances, etc. to the idling control valve, and includes enlargement of the conduction ratio or duty ratio as well as enlargement of an instantaneous value of electric current.

The time that the idling control valve is driven with larger electric current than the upper limit is preferably a time at which no trouble is occurring in the engine operation.

Such a time is a time at which the idling control valve is opened to a maximum opening or to an opening close to the maximum opening, for example, at an engine starting time or at a deceleration time. At the engine starting time, the idling control valve is opened to a large extent to increase the r.p.m. of the engine because engine temperature is low. At the deceleration of the engine, the throttle valve is closed, and the fuel air mixture become richer because of fuel adhered to an inner wall of the manifold. In order to prevent the fuel air mixture from becoming richer, the idling control valve is opened temporarily to a larger opening.

When a starter switch-on state or an ignition switch-on state is detected, or when the engine deceleration is detected, the electric current for driving the idling control valve is released from the upper limit for a period from the detection of such an engine condition, so that electric current larger than the upper limit is supplied to the drive circuit for the idling control valve, whereby even when the valve body of the idling control valve is stuck to a supporting member of the valve body with substances such as dust adhered to the idling control valve, a sufficient driving force of the valve body against the sticking force can be generated.

Once the electric current larger than the upper limit is supplied for driving the idling control valve, to break the sticking of the valve body to the supporting member, then the idling control valve operates smoothly without sticking even when the electric current for driving the idling control valve is limited to within the upper limit.

Since electric current over the upper limit flows for a very short time, for example, 0.1 to 0.2 seconds, power consumption is suppressed to an extremely small value. Moreover, melting damage due to heat generation in the drive circuit is avoided.

DETAILED DESCRIPTION OF THE INVENTION

Figure 1:
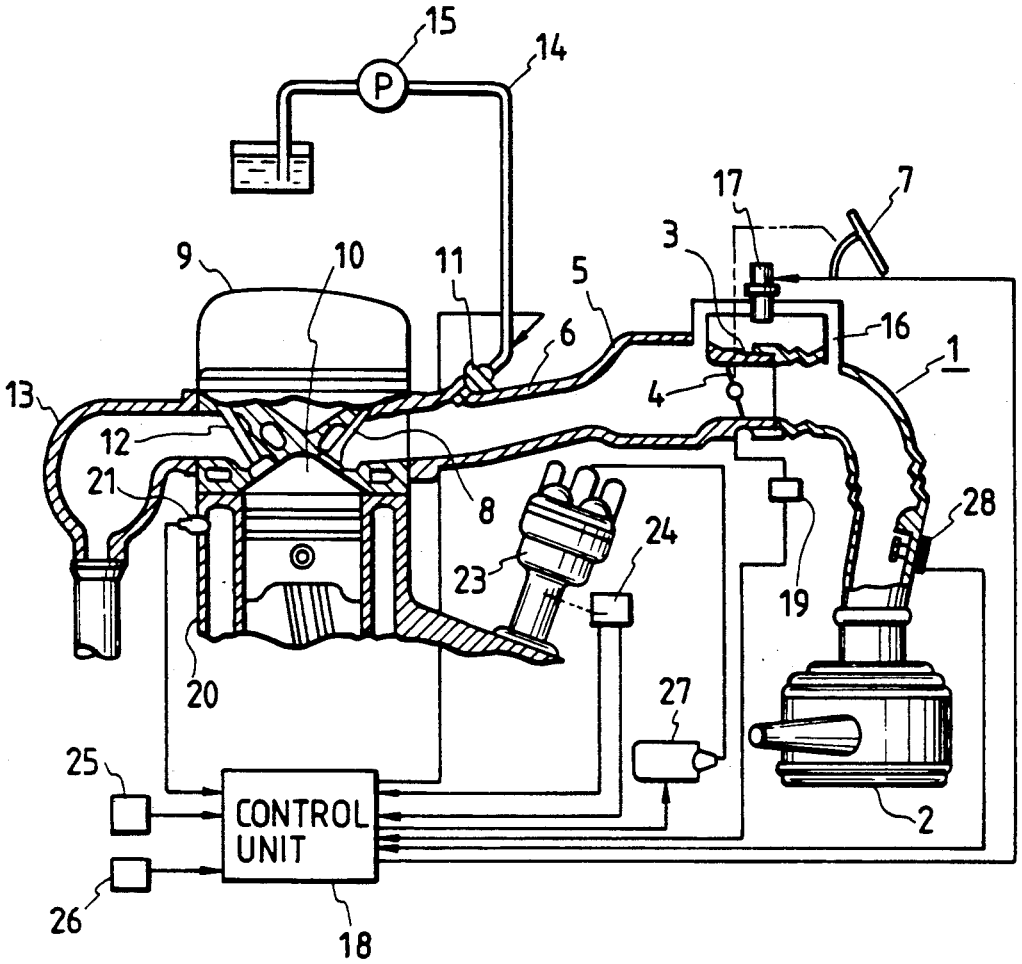
FIG. 1 is a sectional view of an engine system according to the present invention.

An embodiment of the present invention will be described hereunder referring to the drawings.

In FIG. 1 showing a fuel control system of an automobile internal combustion engine, a suction passage 1 of the engine extends from an air cleaner 2 to an engine cylinder 9, and comprises a throttle body 3 with a throttle valve 4, a surge tank 5, and a suction manifold 6. The suction passage 1 is provided with a bypass 16, which bypasses the throttle body 3, and fuel injection valves 11 at the downstream side of the throttle body 3. The fuel injection valves 11 each are connected to a fuel tank through a fuel line with a fuel pump.

In a running operation of the engine, air is sucked through the air cleaner 2, is controlled as to its flow rate by the throttle valve 4 linked to an accelerator pedal, sent to the manifold 6 through the surge tank 5 and mixed with fuel injected by the fuel injection valves 11. The resultant fuel air mixture is supplied into combustion chambers 10 of the cylinder 9 through suction valves 8, and burned. The combustion gas is exhausted into the atmosphere through exhaust valves 12 and an exhaust branch pipe 13.

The fuel injection valves 11, the number of which corresponds to the number of the combustion chambers 10, are arranged in the suction manifold to provide a multi-point injection system however, it is also possible to provide only one fuel injection valve 11 arranged at the upstream side of the throttle valve 4 for single-point injection.

The above-mentioned bypass 16 is an air passage used for idling control, one end of which is disposed in the main suction passage at the upstream side of the throttle valve 4 and the other end of which is provided at the downstream side of the throttle valve 4. In the midway part of the bypass 16, an idle control valve 17 is disposed, which valve is described later in detail referring to FIG. 2.

The fuel control system includes electric engine control unit 18 which comprises a microprocessor as an arithmetic operation part, a ROM storing control programs, control data, etc., a RAM storing information concerning the engine from various sensors and switches, and an I/O.

Various signals are inputted into the control unit 18 from an air flow meter 28 detecting an air flow rate, a throttle sensor 19 detecting a rotational angle of the throttle valve 4, a water temperature sensor 21 mounted on a water jacket 20, a rotational angle sensor 24 detecting the rotational angle of a distributor 23 linked to a crank shaft, an ignition switch 25, a starter switch 26 and a suction air temperature sensor for detecting the temperature of suction air. Based on the various input signals, the control unit 18 calculates an amount of fuel injection and timing of the fuel injection, and sends fuel injection pulse to the fuel injection valve 11. The control unit 18 also calculates ignition timing to send electric current to the ignition coil 27, wherein secondary electric current of the ignition coil 27 is sent to the distributor 23 to distribute it to the ignition plugs. Further, the control unit 18 controls the drive current flowing in the drive circuit of the idle control valve 17 so that an optimum idling control is effected based on data of water temperature, etc. at the time of idling of the engine. In the drive electric current control of the idle control valve 17, a target idling r.p.m. corresponding to a water temperature is set in advance and then a feedback control is effected so that a real engine r.p.m. which is detected will become the target r.p.m.

Figure 2:
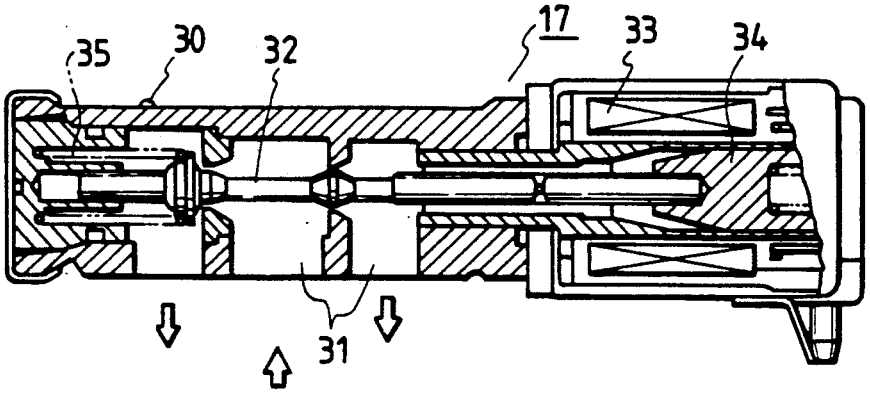
FIG. 2 is a sectional view of an idling control valve used in FIG. 1.

A concrete example of the idle control valve 17 is illustrated in FIG. 2.

The idle control valve 17 is of reciprocation type which is conventional. The valve 17 comprises a valve housing 30 having parts 31 of the bypass formed therein, a valve body 32 incorporated in the valve housing 30, a plunger 34 connected to one end of the valve body 32, a solenoid 33 surrounding the plunger 34 and serving as an element of the drive circuit of the valve 17, and a spring 35 arranged in an opposite end portion of the valve body 22 to the plunger 34 for urging the valve body 22 to a closed condition. With electric power being supplied to the idle control valve 17 to cause a flow of electric current through the solenoid 33, the plunger 34 is electromagnetically attracted so that the valve body 32 is moved axially against the spring force of the spring 35. An opening of the air passage 31 (passage area) is variably controlled by the electromagnetic-attraction force, that is to say, the opening of the air passage 31 is determined by such a position of the valve body 32 that the electromagnetic attraction force balances the spring force of the spring 35. An air flow rate of the air passage 31, that is to say, a flow rate of air flowing in the bypass 16 is controlled by the opening of the air passage 31. The air flow rate is detected by a flow meter 28, and an amount of fuel is injected according to the air flow rate by the fuel injection valve 11.

Figure 3:
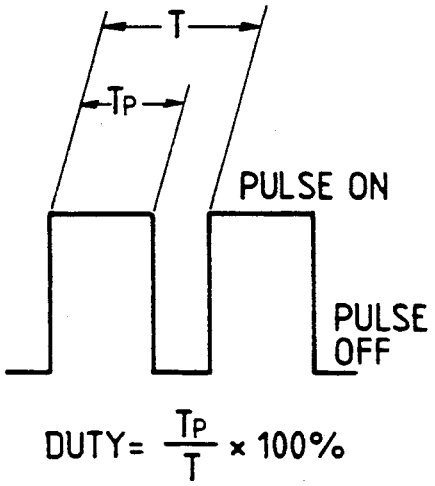
FIG. 3 is a diagram for explaining a duty ratio.

Electric current for driving the idle control valve 17 is controlled, for example, by a duty-controlled pulse signal illustrated in FIG. 3.

Figure 4:
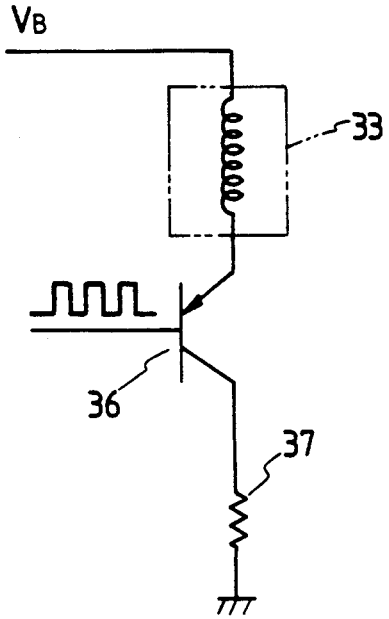
FIG. 4 PRIOR ART
FIG. 4 is a conventional drive circuit for an idling control valve.

A conventional idle control valve drive circuit is shown in FIG. 4. The drive circuit comprises the solenoid 33 incorporated in the idle control valve 17 as a part of an actuator thereof, a power transistor (switching element) 36 and an electric resistor 37.

Pulse signals for controlling the idle control valve 17 are sent to a base of the power transistor 36 from the control unit to turn on and off the power transistor 36, whereby a time period $T_p$ for which a battery voltage $V_b$ is applied is changed to control the electric current supplied to the solenoid 33. The resistor 37 suppresses electric current flowing into the solenoid 33 thereby to prevent overheating of the solenoid 33.

Figure 5:
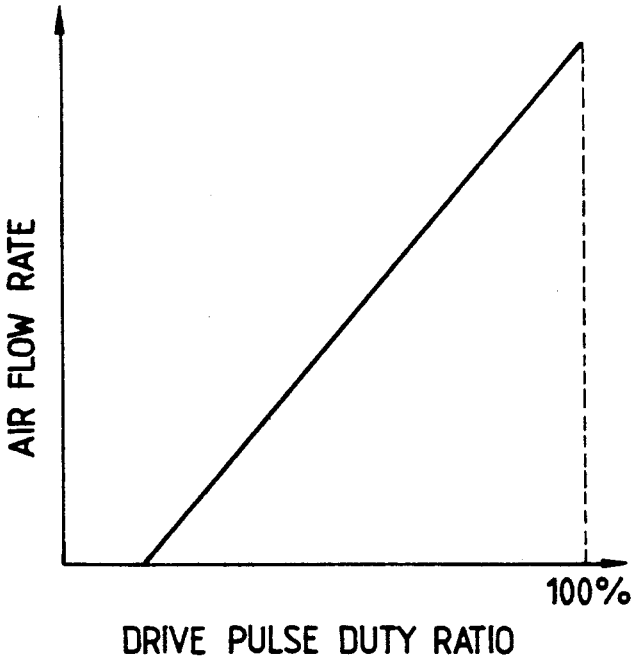
FIG. 5 is an illustration showing a characteristic line of a relation between duty ratio and an air flow rate.

The air flow rate controlled by the idle control valve 17 is approximately proportional to a ratio between a pulse duration $T_p$ and a pulse cycle T, that is to say, a duty ratio, and has a characteristic as shown in FIG. 5.

In the above-mentioned conventional circuit, the maximum value of electric current flowing in the idle control valve drive circuit is as follows at the duty ratio of 100%;

$$i_{max} = \frac{V_b}{R_1 + R_2}$$

,wherein $R_1$ is resistance of the solenoid 32, $R_2$ is resistance of the resistor 37, and $V_b$ is battery voltage.

In the conventional drive circuit even if substances such as dust, oil vapor, carbon, etc. adhere to a movable portion of the idle control valve 17, the electric current for driving the idle control valve 17 is limited to the upper limit, and the duty control is effected by an usual idling control signal.

When the adhesion of the substances to the movable portion of the idle control valve 17 becomes remarkable, the adhesive force of the movable portion is beyond the maximum thrust force caused by the electric current supplied to the solenoid through the duty control, so that the idle control valve 17 becomes inoperable and the air flow rate control can not be effected at the time of idling. In the conventional drive circuit, electric current is caused to flow at the duty ratio of 100%, and there were some cases in which the thrust drive force of the electromagnetic force could not be stronger than the adhesive force because of the resistance Re of the resistor 37.

An example of an electric circuit for driving the idle control valve 17 according to the present invention will be described hereunder in detail referring to FIGS. 6 to 8.

In this embodiment, for some parts, the same reference numerals as in FIG. 4 are used, and the parts having the same reference numerals are the same or similar elements to parts in FIG. 4.

The drive circuit comprises a solenoid 33, a first power transistor (PNP type) 36, a resistor 37 and a second power transistor 38 (switching element), provided in parallel to the resistor 37, or arranged so as to bypass the resistor 37. Namely, the resistor 37 and the second power transistor 38 are provided in parallel between the corrector of the first power transistor 36 and the ground.

In this embodiment, except for a limited short time at the time of starting of the engine, the second power transistor 38 is controlled to be in the off-condition while the first power transistor 36 is controlled to turn off and on by the duty controlled idle control signal as usual. Therefore, even if a maximum electric current flows at the duty ratio of 100%, the electric current flows through the resistor 37 having a resistance $R_2$, so that the maximum electric current is suppressed to $V_b/(R_1+R_2)$, whereby heating of the solenoid is suppressed.

At the time of starting of the engine, the second power transistor 38 is controlled to turn on for a certain constant short time, for example during the driving of a starter motor, and the first power transistor 36 is supplied, through the base thereof, with the idling control valve control signal controlled to the duty ratio of 100% in synchronism with the turning on of the second power transistor 38.

By the electric current control in this manner, the electric current at the duty ratio of 100% flows bypassing the resistor 37 for driving the valve 17, so that the electric current can be raised to the maximum value $V_b/R_1$.

Figure 7:
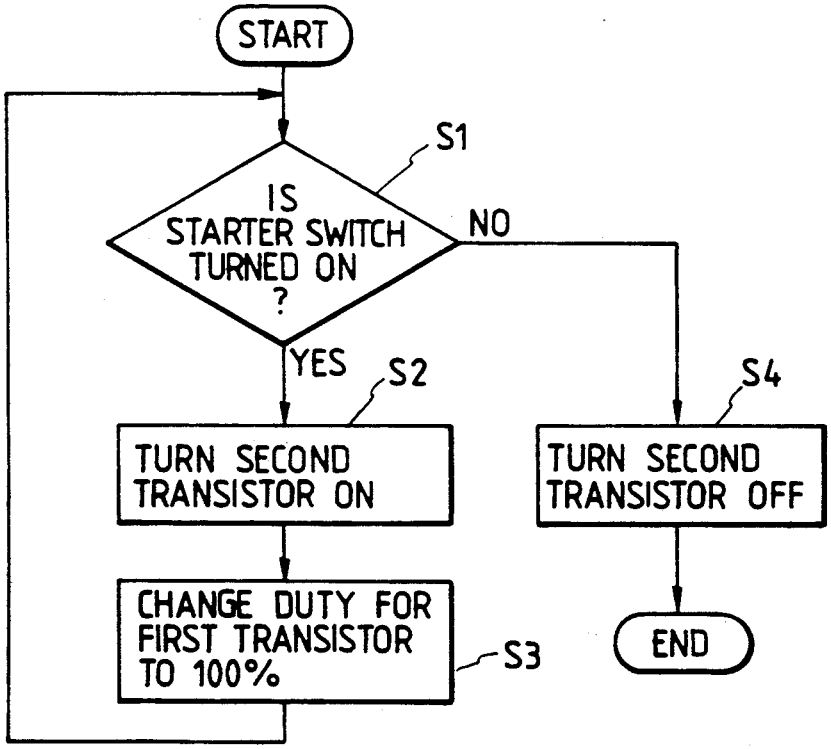
FIG. 7 is a flow chart for explaining an operation of the drive circuit of FIG. 6.

Referring to FIG. 7 a control of electric current for driving the idle control valve 17 is described hereunder.

In FIG. 7, the electric control unit 18 inputs a signal from the starter switch 26 at step St. When the signal represents —on—, the second power transistor 38 of the idle control the second power transistor 38 is turned on for a short time, for example, only during the operation of the starter motor at step $S_2$. At the same time, the idling control signal is controlled is to its duty so that the duty ratio is 100%, at step $S_3$.

After the start switch is turned off, the second power transistor 38 also is turned off, and the idle control valve 17 is subjected to the normal duty control at the time of idling at step $S_4$.

According to this embodiment, at the time of engine starting at which the movable portion of the idle control valve 17 is apt to stick, the electric current for driving the idle control valve 17 is temporarily made larger than the upper limit ($V_b/(R_1+R_2)$) in the usual operation, whereby the electromagnetic attraction force, that is to say, the thrust force of the valve body is made larger, so that even if sticking takes place, the idling control valve 17 can move axially against the sticking force. Once the sticking condition disappears, the sticking force is reduced substantially to zero so that, after that, the idle, control valve 17 can be operated normally.

The on time of the second transistor 38 is very short, for example, 0.1 to 0.2 seconds, so that power consumption is reduced remarkably, and even if the electric current for driving the idle control valve 17 goes temporarily beyond the upper limit, burning damage of the drive circuit for the idle control valve 17 does not take place.

Another embodiment of the present invention will be described hereunder referring to FIGS. 8 and 9.

Figure 8:
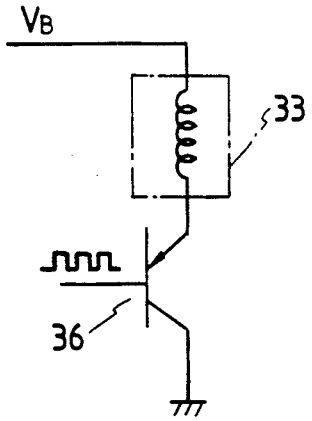
FIG. 8 is a diagram of another embodiment of a drive circuit for an idling control valve according to the present invention.

In FIG. 8, a drive circuit comprises a solenoid 33, and a power transistor 36. In comparison with the drive circuit shown in FIG. 4. The drive circuit of the present embodiment has the resistor shown in FIG. 4 omitted.

In the drive circuit, electric current over the upper limit flows by setting the duty ratio to 100%. Namely, under usual idling control, electric current control is effected in a range of the duty ratio of less than 100%, for example, within a range of the duty ratio of 0 to 80%. Only during the starting of the engine, the upper limit (duty ratio 80%) is released, and the idle control valve 17 is constructed so that a driving force beyond the sticking force is generated by the solenoid at the duty ratio of 100%.

Figure 9:
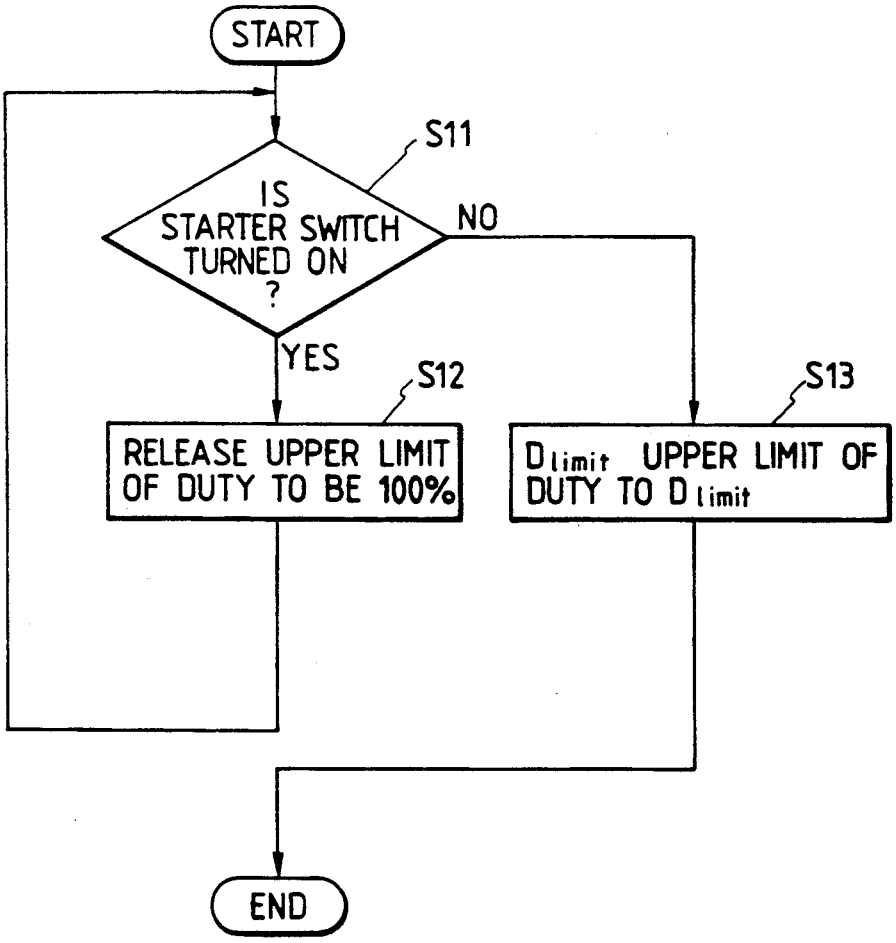
FIG. 9 is a flow chart for explaining an operation of the drive circuit of FIG. 8.

In FIG. 9, in a step $S_{11}$, whether or not the starter switch is turned on is judged. When the starter switch is on, the upper limit D is released for a set short time, and the duty ratio is set to 100% in a step $S_{12}$. When the starter switch is changed to the off condition, the upper limit of the duty ratio is set to D limit in a step $S_{13}$ and within the limit, the duty control is effected to drive the idle control valve 17. The upper limit limit is an electric current value which is an upper limit of an electric current for usual operation of the idle control valve 17 and at which the idle control valve 17 can be kept at a maximum opening while saving power consumption and suppressing heat generation at the solenoid.

Figure 6:
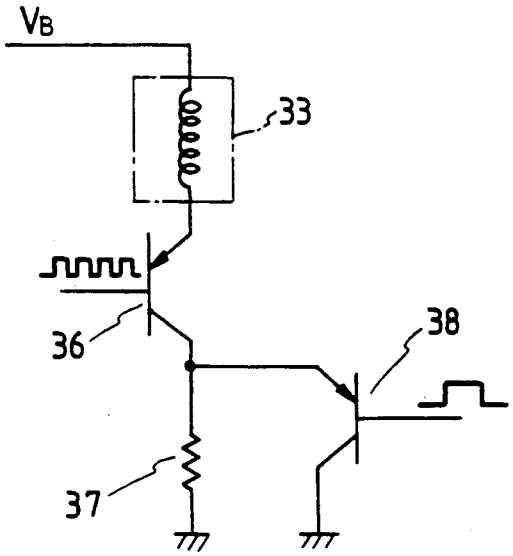
FIG. 6 is a diagram of a drive circuit for an idling control valve of an embodiment of the present invention.

In the above two embodiments, the drive circuits shown in FIGS. 6 and 7 each are included in the control unit 18 except for the solenoid 33.

What is claimed is:

1. A method of controlling an idling control valve of an internal combustion engine, which valve is mounted in a bypass air passage bypassing a throttle valve portion of an air suction passage to control a flow rate of air flowing in the bypass air passage, said method comprising the steps of:

setting an upper limit of electric current for driving the idling control valve to limit the electric current within the upper limit when the engine is under a usual operational condition; and releasing the electric current from the upper limit for a short time in an engine operation so that the idling control valve is driven with larger electric current than the upper limit.

2. The method according to claim 1, wherein the electric current for driving the idling control valve is released from the upper limit for a short time at least during one time of a starting time and a deceleration time of the engine.

3. The method according to claim 1, wherein the electric current for driving the idling control valve is released from the upper limit for a short time at regular intervals during operation of the engine.

4. The method according to claim 1, wherein the larger electric current is set to a value at which the idling control valve can be operated against an obstructing force of movement of the idling control valve, which force is generated by adhesion of substances to the idling control valve.

5. A method of controlling an idling control valve, mounted in a bypass bypassing a throttle portion of an air suction passage of an internal combustion engine, for controlling a flow rate of air flowing into the engine through the bypass with the idling control valve, wherein the idling control valve is operated with a driving force within a predetermined value during a usual operation of the engine, and the idling control valve is operated with a larger driving force than the predetermined value for a short time at a certain engine operational time, the larger driving force being of a sufficient value to cause the idling control valve to operate against force generated by adhesion of substances to the idling control valve and acting to obstruct the movement of the idling control valve.

6. A method according to claim 5, wherein said idling control valve is opened to an extent that the opening is beyond an opening of a usual engine idling operation with a larger driving force for a short time at a starting of the engine.

7. An apparatus for controlling an idling control valve, mounted on a bypass bypassing a throttle portion of an air suction passage of an internal combustion engine, for controlling a flow rate of air flowing in the bypass, said apparatus comprising:

restriction means for restricting electric current supplied to said idling control valve to an upper limit under which a usual operation of said idling control valve is effected;

means for detecting engine states; and means for releasing the electric current from said restriction means to flow larger electric current to said idling control valve for a short time at one state of the detected engine states.

8. The apparatus according to claim 7, wherein when at least one of a on-state of an ignition switch, an on-state of a starting switch and a deceleration state of the engine is detected by said means for detecting engine states, the electric current to said idling control valve is released from said restriction means.

9. An apparatus for controlling an idling control valve, mounted on a bypass bypassing a throttle portion of an air suction passage of an internal combustion engine, for controlling a flow rate of air flowing in the bypass, said apparatus comprising:

means for controlling electric current to be supplied to an electric solenoid of said idling control valve by electric pulses with duty ratio thereof being changed according to water temperature in a usual operation of said idling control valve;

means for restricting the electric current to an upper limit so as to supply the electric current within the upper limit to said electric circuit in the usual operation;

means for detecting states of the engine; and means for flowing electric current more than said upper limit to be supplied to said idling control valve for a short time at a certain state of the detected engine states.

10. The apparatus according to claim 9, wherein said means for restricting electric current is a resistor, and said means for flowing electric current more than the upper limit is a switching element provided in parallel to said resistor so as to allow larger electric current to flow bypassing said resistor.

11. The apparatus according to claim 9, wherein said means for restricting electric current is a means for setting duty ratio of electric pulse for controlling electric current to said solenoid to a value less than 100% at which a usual operation of said idling control valve can be effected, and said means for restricting electric current is a means for changing the duty ratio of the value less than 100% to 100%.

12. An apparatus for controlling an idling control valve for an internal combustion engine, mounted in a bypass bypassing a throttle portion of a suction passage, comprising:

a drive circuit for driving said idling control valve with electric current supplied thereto, said drive circuit comprising a solenoid mounted on said idling control valve and electrically connected to a power source, a first switching element electrically connected to said solenoid for controlling electric current to said solenoid from said power source, a resistor for restricting the electric current to said solenoid, and a second switching element, provided in parallel to said resistor, for releasing the electric current from the resistor; and a control unit receiving data from various sensors including a throttle sensor an air flow sensor and a revolutional angle sensor, an ignition switch, and a starter switch, for generating signals for controlling said switching elements according to engine operational conditions.

* * * * *